US005238292A

United States Patent [19]

Golenz et al.

[11] Patent Number: 5,238,292

[45] Date of Patent: Aug. 24, 1993

[54] HIGHCHAIR WITH ADJUSTABLE SEAT

[75] Inventors: Douglas J. Golenz, Westminster; Robert M. Parker, Aurora; Roy E. Knoedler, Boulder, all of Colo.

[73] Assignee: Gerry Baby Products Company, Denver, Colo.

[21] Appl. No.: 754,533

[22] Filed: Sep. 4, 1991

[51] Int. Cl.[5] ..... A47B 83/02

[52] U.S. Cl. ..... 297/153; 297/149

[58] Field of Search ..... 297/148, 149, 151, 153, 297/340, 344, 345, 346, 353; 248/188.8, 188.9

[56] References Cited

U.S. PATENT DOCUMENTS

| | | | |
|---|---|---|---|
| 127,439 | 6/1872 | Sweet | 297/353 |
| 706,835 | 8/1902 | Learned | 297/345 X |
| 1,983,138 | 12/1934 | Lehman | 155/127 |
| 2,024,667 | 12/1935 | Stinson | 155/127 |
| 2,409,622 | 10/1946 | Gottfried | 248/188.9 |
| 2,505,490 | 4/1950 | Greenbaum | 155/127 |
| 2,515,527 | 7/1950 | Robinson | 297/345 X |
| 2,521,422 | 9/1950 | Strand, Jr. | 155/54 |
| 2,767,774 | 10/1956 | Derby | 297/149 |
| 2,799,324 | 7/1957 | Anderson | 157/127 |
| 2,834,404 | 5/1958 | Groome | 297/345 |
| 3,377,966 | 4/1968 | Bates et al. | 297/345 X |
| 3,542,419 | 11/1970 | Spinola | 297/345 X |
| 4,105,247 | 8/1978 | Saint | 297/149 |
| 4,722,570 | 2/1988 | Bertoli | 297/345 |
| 4,807,928 | 2/1989 | Cone | 297/153 |
| 4,842,331 | 6/1989 | Waples | 297/149 |
| 4,915,335 | 4/1990 | Miles | 248/188.8 |
| 4,968,092 | 11/1990 | Giambrone | 297/153 X |

FOREIGN PATENT DOCUMENTS

| | | | |
|---|---|---|---|
| 461807 | 12/1949 | Canada . | |
| 0387764 | 9/1990 | European Pat. Off. | 297/345 |
| 464806 | 4/1937 | United Kingdom . | |
| 2177907 | 2/1987 | United Kingdom | 297/345 |

*Primary Examiner*—Kenneth J. Dorner
*Assistant Examiner*—Milton Nelson, Jr.
*Attorney, Agent, or Firm*—Biebel & French

[57] ABSTRACT

A highchair is provided including a tray portion which may be adjusted horizontally relative to a seat portion of the chair. In addition, a seat may be adjusted vertically whereby the highchair may be used adjacent to tables of various heights. The chair of the present assembly is also provided with laterally outwardly extending foot portions whereby the stability of the highchair is improved.

14 Claims, 10 Drawing Sheets 72
86
12
82
84
5
5
24
74
78
26
76
80
92
98
142
144
140
22
156
152
152
156
154
154
156
152
156
154
146
154
152

HIGHCHAIR WITH ADJUSTABLE SEAT

BACKGROUND OF THE INVENTION

The present invention relates to a highchair and, more particularly, to a highchair having a horizontally adjustable tray and a vertically adjustable seat.

Highchairs which include horizontally adjustable trays in which latching means are provided to position the tray at different horizontal positions, as well as to provide a mechanism for removing the tray from the chair, are well known. For example, U.S. Pat. No. 4,842,331 to Waples discloses a highchair having a tray with side latching mechanisms for engaging the arm portions of a highchair and an adjustment plunger is provided at a center forward edge of the tray for remotely actuating the latches. In this mechanism, the latches may be directly engaged by an operator without manually engaging the adjustment plunger. However, this operation can have the undesirable effect of the linkages 64, 66 causing the adjustment plunger to move outwardly and possibly contact the operator manipulating the latches.

It is also typical for prior art highchairs to have a seat portion which is at a fixed vertical height, which construction proves to be inconvenient when the highchair is used adjacent to a table having a different height from the highchair. Further, any vertical height adjustment structure would require a departure from the common structure used for highchairs in which the seat forms a pivoted part of a parallelogram hinge mechanism for folding the chair, such as is shown in U.S. Pat. No. 4,105,247 to Saint.

Accordingly, there is a need for a highchair having a horizontally adjustable tray in which side latching members of the tray may be manipulated independently of movement of a central forward latch actuator.

In addition, there is a need for a highchair in which the vertical position of the seat portion of the chair may be adjusted relative to the supporting base for the chair whereby the chair may be used in association with tables having various heights.

SUMMARY OF THE INVENTION

The present invention provides a highchair including a seat having arm portions and a removable tray adapted to be positioned on the arm portions.

Latch members are mounted on the lower surface of the tray for movement toward and away from engaging surfaces formed on the arm portions. An actuator is also mounted on the lower surface adjacent to the front edge of the tray for manual engagement by an operator. Movement of the actuator is transferred to the latch members via a transfer means which is mounted for pivotal movement on the lower side of the tray and in a centrally located portion thereof. The transfer means is connected to the actuator through a first linkage and the transfer means is connected to the opposing latch members by second linkages extending laterally from the transfer means.

Manual operation of the actuator in a rear to front direction relative to the tray causes the second linkages to push laterally outwardly on the latch members such that the latch members disengage from the arm portions of the seat for adjustment of the tray relative to the arm portions and for removal of the tray from the chair.

The first linkage is connected to the actuator through a lost motion connection comprising a slot formed in the actuator for receiving the first linkage whereby the actuator may remain stationary when the latch members are directly manually operated. Thus, forced operation of the actuator will only occur when an operator manually pulls out on the actuator to cause movement of the latch members.

The highchair of the present invention further includes leg members comprising two front legs and two rear legs and attachment means for attaching the seat to the leg members. The attachment means may be fixedly looked at different positions along the leg members whereby the distance between the seat and floor engaging portions on the leg members may be varied to vary the height of the seat above a floor supporting the floor engaging portions.

The attachment means preferably comprises a collar member extending around each of the front legs wherein each of the collar members is attached to a respective leg for sliding movement relative to the leg. The front legs further include a plurality of longitudinally spaced apertures for receiving a plunger which is spring biased through the collars in order to fixedly attach the seat at one of a plurality of predetermined vertical positions.

Adjacent front and rear legs are attached in pivotal relation to each other by hinge members and a glide member is attached in stationary relationship to each of the hinge members. The seat is formed with a slot for receiving a portion of the glide member whereby a seat back portion of the seat is guided during movement of the attachment means relative to the front legs. In this manner, the seat is supported in a substantially constant angular position relative to the leg members.

The front leg members have a substantially constant lateral distance therebetween and the rear legs are similarly formed with a constant lateral distance therebetween. In order to provide further stability in preventing sideways tipping of the chair, the floor engaging portions are formed as triangular members having side edges which angle outwardly at an obtuse angle relative to a portion of a respective leg immediately above the side edge. Thus, the floor engaging portions provide a further width dimension to the bottom of the leg members to thereby avoid the danger of the chair tipping over laterally.

Therefore, it is an object of the present invention to provide a highchair having a horizontally adjustable tray including side latching members and a centrally located actuator member. The actuator is connected to the latching members through a lost motion connection such that the latching members may be operated without movement of the actuator.

It is another object of the invention to provide a highchair having a vertically adjustable seat wherein the position of the chair may be selected from a plurality of predetermined positions.

It is a further object of the invention to provide a highchair having floor engaging portions which extend laterally outwardly from leg members to provide further stability for the highchair.

Other objects and advantages of the invention will be apparent from the following description, the accompanying drawings and the appended claims.

DETAILED DESCRIPTION OF THE PREFERRED EMBODIMENT

Figure 1:
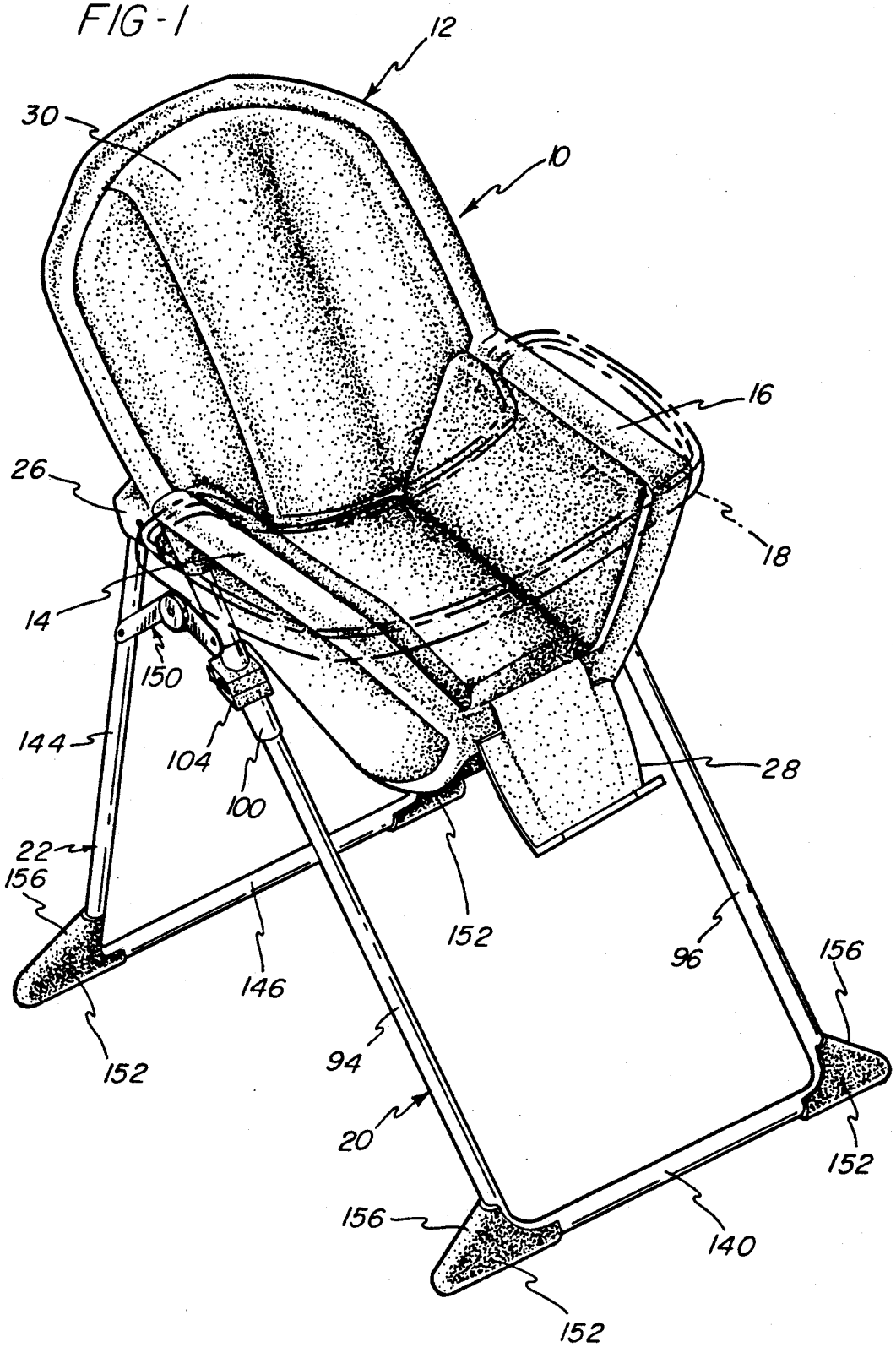
FIG. 1 is a perspective view of the highchair of the present invention.
Figure 10:
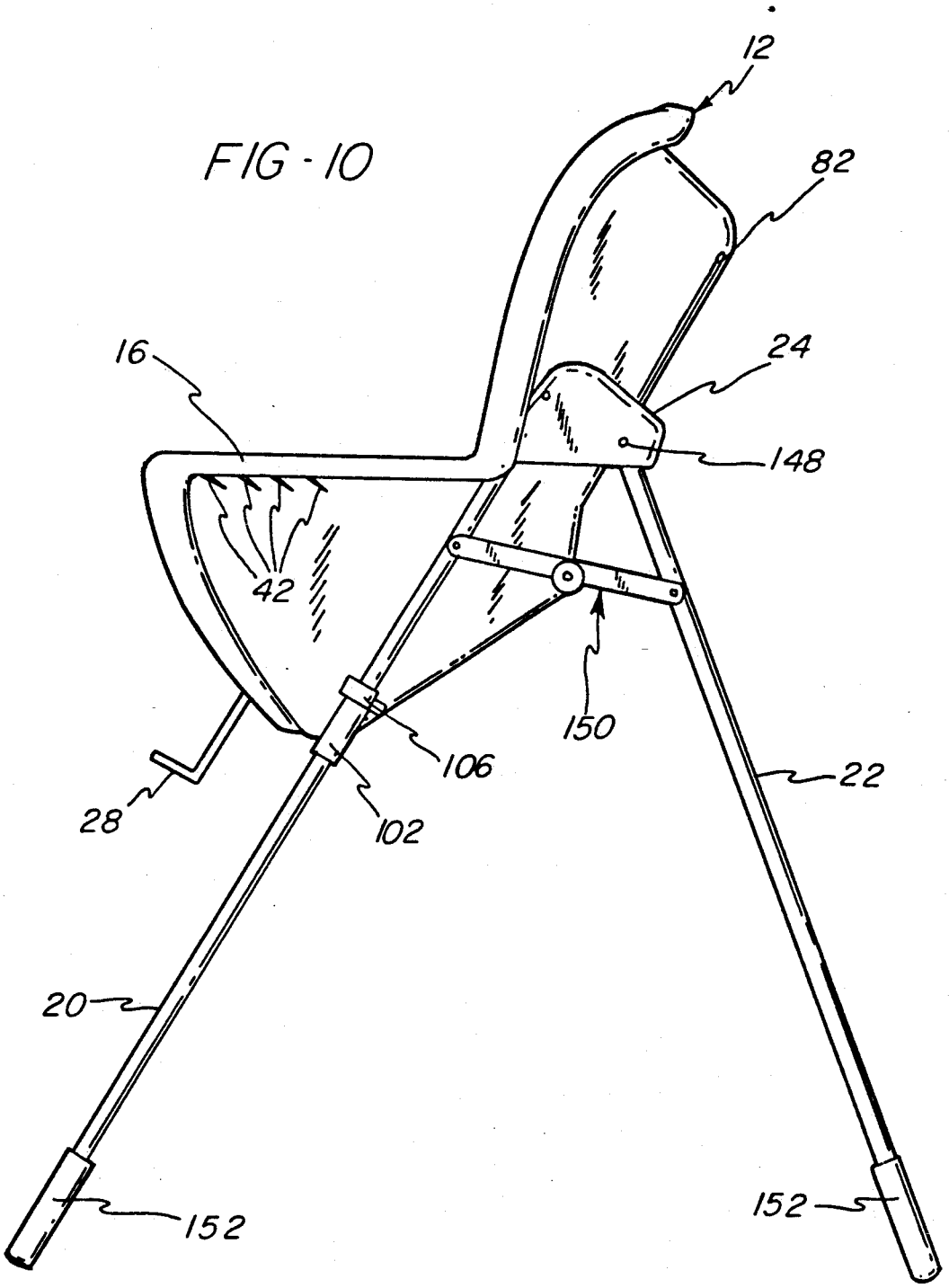
FIG. 10 is a side elevational view of the highchair.

Referring to FIG. 1, the highchair 10 of the present invention includes a seat portion 12 having a pair of arms 14, 16 for supporting a tray 18. Front and rear leg members 20, 22 are attached in pivotal relation to each other at left and right hinges 24, 26 (see also FIG. 10). In addition, an adjustable footrest 28 is attached to a lower portion of the seat 12.

Figure 2:
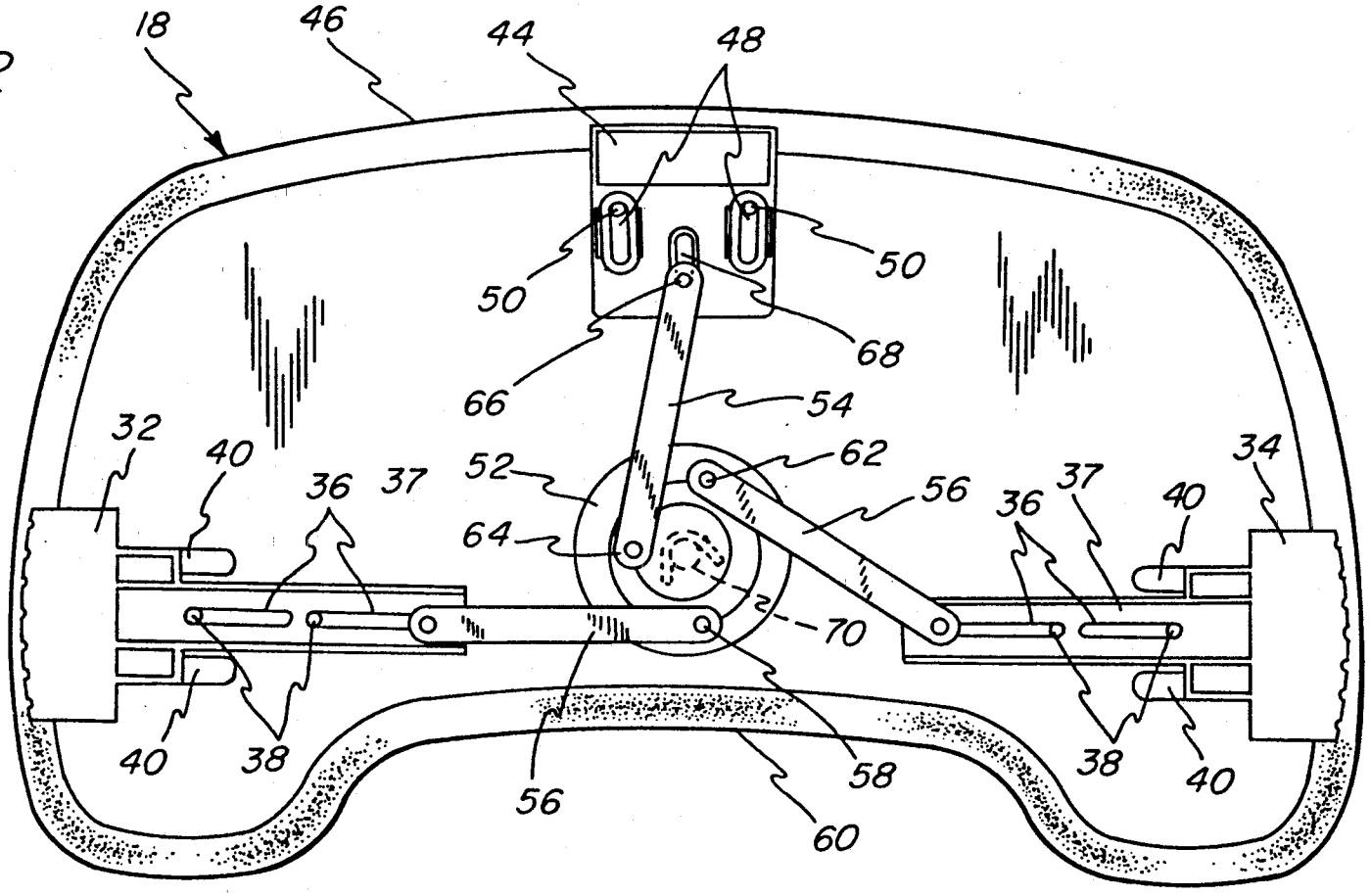
FIG. 2 is a plan view of the bottom of the tray showing the latching members in a latched position.

The tray 18 includes means whereby the horizontal position of the tray may be adjusted in a horizontal front to rear direction relative to a back portion 30 of the seat 12. Referring to FIG. 2, the tray 18 includes a pair of latch members 32, 34 located adjacent to opposite lateral sides of a bottom portion of the tray 18. Each of the latch members 32, 34 includes a pair of lateral slots 36 formed in arm portions 37 which receive a pair of guideposts 38 for guiding the latch members 32, 34 in lateral movement toward and away from the center of the tray 18.

A pair of latch fingers 40 is formed integrally with each of the latch members 32, 34 to engage in spaces formed between ribs 42 (see FIG. 10) formed integrally with the underside of each of the arms 14, 16. The latch fingers 40 are spaced from the arm portions 37 in a direction away from the tray whereby the fingers 40 are positioned below the arm portions 37 when the tray is in use, and the edges of the arms 14, 16 are received between the fingers 40 and the arm portions 37. Thus, when the latch members 32, 34 are moved slightly outwardly, the tray 18 may be moved along the arms 14, 16 to alter the spacing of the tray 18 from the seat back 30, and the tray 18 may be locked in position when the fingers 40 are moved into the spaces formed between the ribs 42. The movement of the latch members 32, 34 is effected through an actuator 44 centrally located on the underside of the tray adjacent to a front edge 46 of the tray. The actuator 44 includes a pair of slots 48 receiving a pair of guideposts 50 for guiding the actuator in movement parallel to the bottom of the tray 18 in a rear to front direction.

Figure 3:
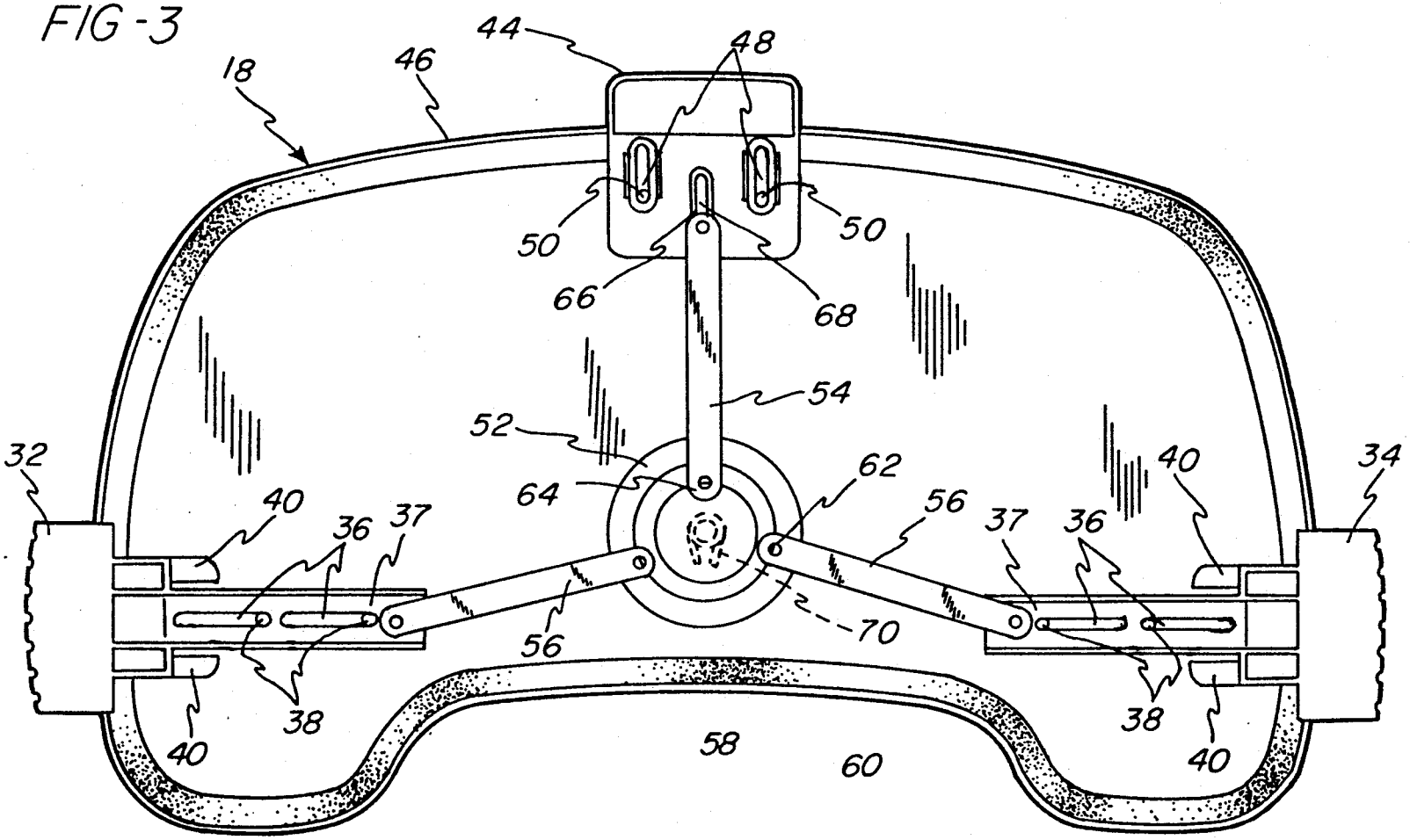
FIG. 3 is a view similar to FIG. 2 with the latching members in an unlatched position.

The actuator 44 is connected to the latch members 32, 34 via a transfer hub 52 located centrally on the tray 18 between the latch members 32 and 34. The transfer hub 52 is mounted for rotational movement and is connected to the actuator 44 through a first linkage 54. Second linkages 56 connect the transfer hub 52 to the latch members 32, 34. The connection point 58 for the second linkage member 56 extending from the latch member 32 is located at a point on the transfer hub 52 which is adjacent to a rear edge 60 of the tray 18 and the other second linkage 56 extending from the latch member 34 is located at a point 62 on the hub 52 which is distal from the rear edge 60. Thus, when the transfer hub 52 rotates in a clockwise direction, as seen in FIG. 3, the second linkages 56 will push the latch members 32, 34 laterally outwardly to disengage the fingers 40 from the arms 14 and 16.

The first linkage 54 is connected to the transfer hub 52 at a circumferential point 64 spaced from the center of the hub 52 and located approximately midway between the front and rear edges of the hub 52. The opposing end 66 of the linkage 54 is connected to the actuator 44 at the rearward edge of a slot 68 such that when the actuator 44 is manually pulled out, the rearward edge of the slot 68 will cooperate with the end 66 of the first linkage 54 to rotate the transfer hub 52 whereby the latch members 32, 34 are positioned laterally outwardly, as shown in FIG. 3.

It should be noted that the latch members 32, 34 may be directly engaged by an operator pulling the latch members 32, 34 outwardly which in turn will result in rotation of the transfer hub 52. However, since the actuator 44 is provided with a slot 68 at the connection with the first linkage 54, the actuator 44 will not be moved outwardly. This is advantageous since many times the operator of the latch members 32, 34 will be standing in contact with the front edge 46 of the tray 18 such that actuation of the latch members 32, 34 would be resisted as the actuator 44 contacts the operator if the lost motion mechanism formed by the connection between the end 66 and the slot 68 were not provided.

The actuation mechanism for the latch members 32, 34 further includes a torsion spring 70 positioned between the transfer hub 52 and the bottom of the tray 18. The spring 70 operates to return the mechanism to the position shown in FIG. 2 when the actuator 44 is released from its actuated position, as shown in FIG. 3. Alternatively, if the latch members 32, 34 are directly manually actuated, the spring 70 will also act to draw them inwardly when they are released.

It should be noted that FIG. 3 shows the position of the latch members 32, 34 being fully extended which will permit the tray 18 to be removed from the arms 14, 16. Movement of the latch members 32, 34 to a position intermediate the positions shown in FIGS. 2 and 3 will permit the horizontal position of the tray 18 to be adjusted while maintaining the tray 18 on the arms 14, 16.

Figure 4:
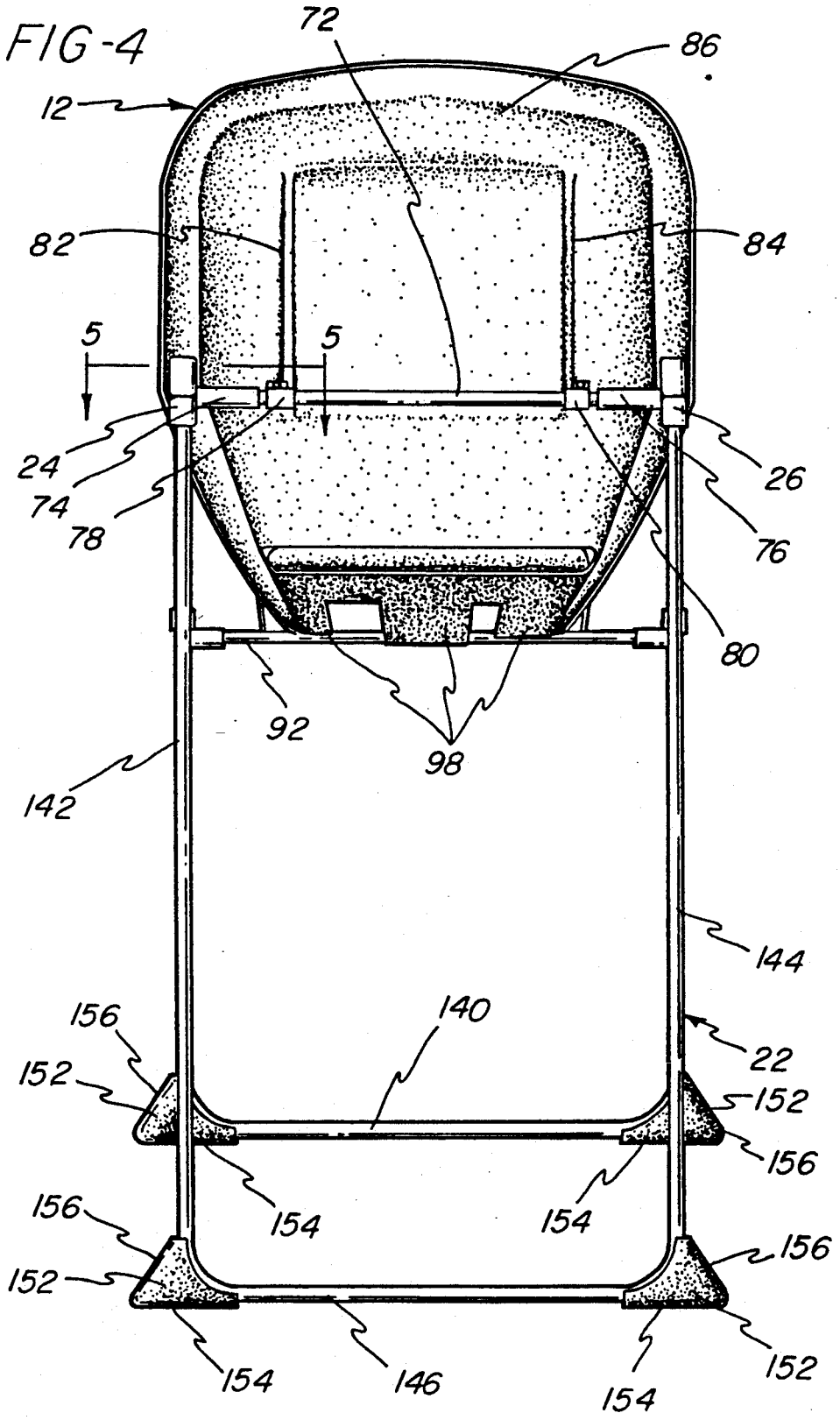
FIG. 4 is a rear view of the highchair without the tray.

Referring to FIG. 4, a tubular bar 72 extends between the hinges 24, 26 and engages within tubular extensions 74, 76 formed integrally with the hinges 24, 26. A pair of glide members 78, 80 are mounted to the bar 72 laterally inwardly from respective extensions 74, 76 and are received within slots 82, 84 formed integrally with a back surface 86 of the seat 12. As may be seen in FIG. 5 in which the glide member 78 is illustrative of the structure of both glide members 78, 80, the glide member 78 includes a cylindrical body portion 88 for receiving the tube 72 and a tang portion 90 positioned in spaced relationship to the body 88 and received within the slot 82. Thus, it should be apparent that the bar 72 acts to hold the hinges 24, 26 in constant spaced relationship and additionally acts to position the glide members 78, 80 in engagement with the slots 82, 84.

The glide members 78, 80 are adapted to slide within the slots 82, 84 whereby the seat back 86 is held in a constant spaced relationship relative to the hinges 24, 26. Further, the cooperating glide members 78, 80 and slots 82, 84 maintain the constant spaced relationship throughout a vertical movement of the seat 12 whereby the upper portion of the seat 12 is held in a predetermined position during such a vertical movement.

Figure 5:
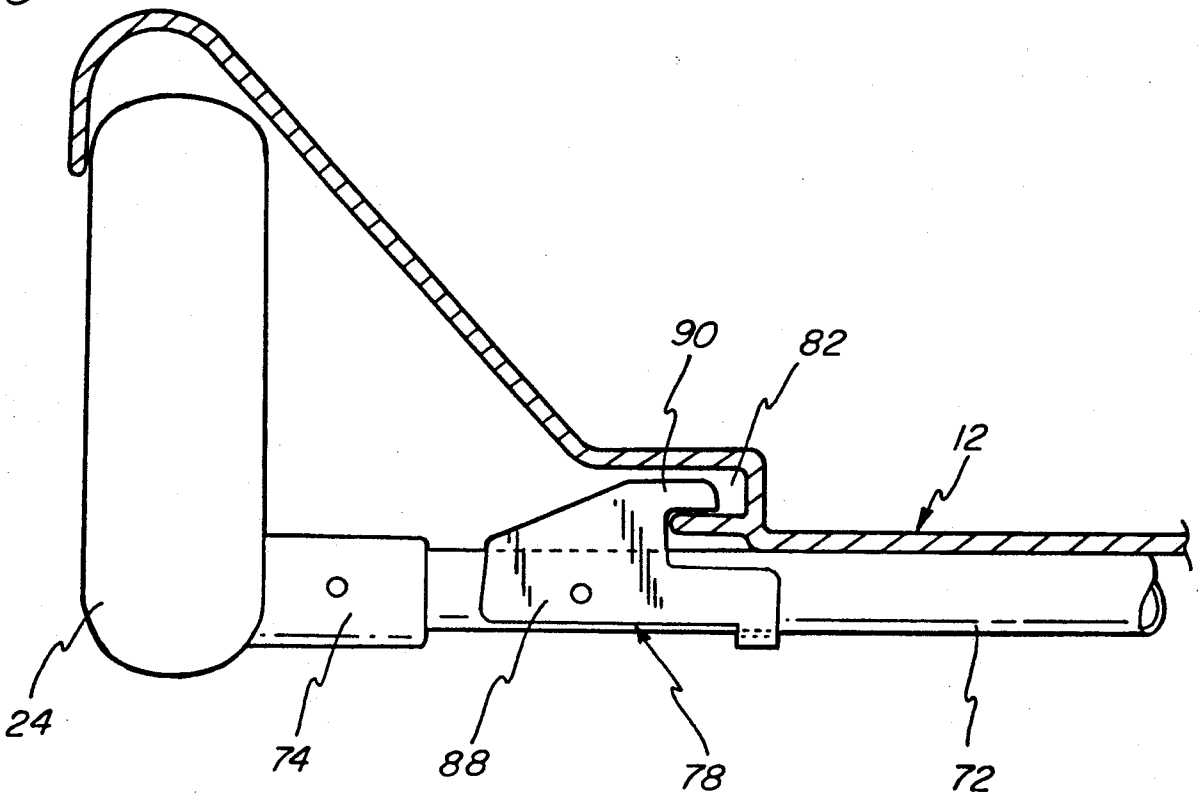
FIG. 5 is a cross-sectional view taken along line 5—5 in FIG. 4 and with the background eliminated for clarity.
Figure 6:
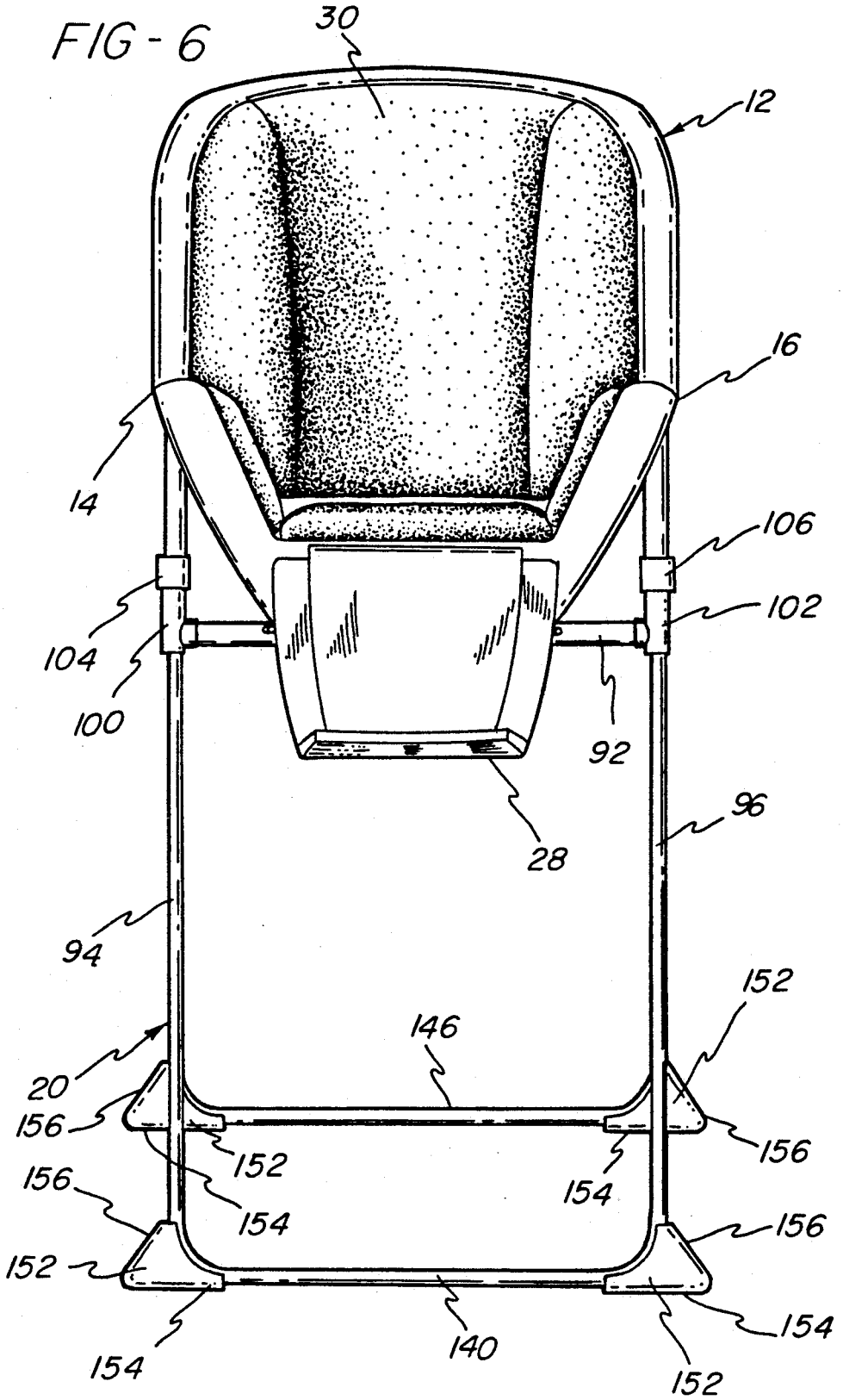
FIG. 6 is a front view of the highchair without the tray.

Referring to FIGS. 5 and 6, the lower front portion of the seat 12 is supported by a second bar 92 extending between upright elements 94, 96 of the front leg member 20. The tube 92 is attached to the seat 12 by tongue members 98 which are preferably formed integrally with the lower surface of the seat 12 and which wrap around the tube 92 to immovably hold the tube 92 and seat 12 together. The tube 92 attaches to the leg elements 94, 96 via sleeve or collar members 100, 102 which are slidably received on the leg elements 94, 96. Each of the collar members 100, 102 includes a push button 104, 106 for selectively locking the collar members 100, 102 at predetermined vertical positions along the leg elements 94, 96.

Figure 7:
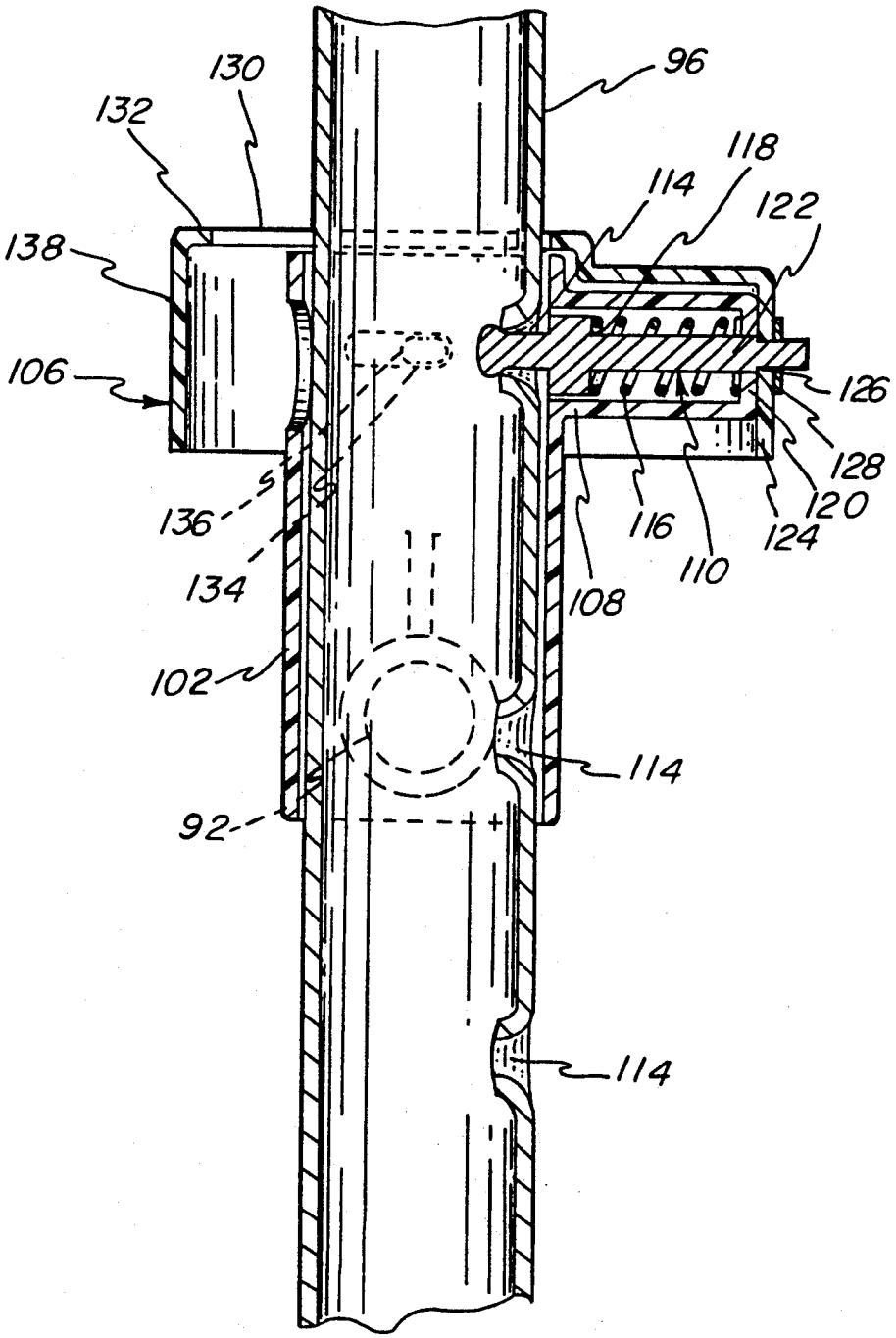
FIG. 7 is a cross-sectional view through a front leg showing the collar member locked in a stationary position.
Figure 8:
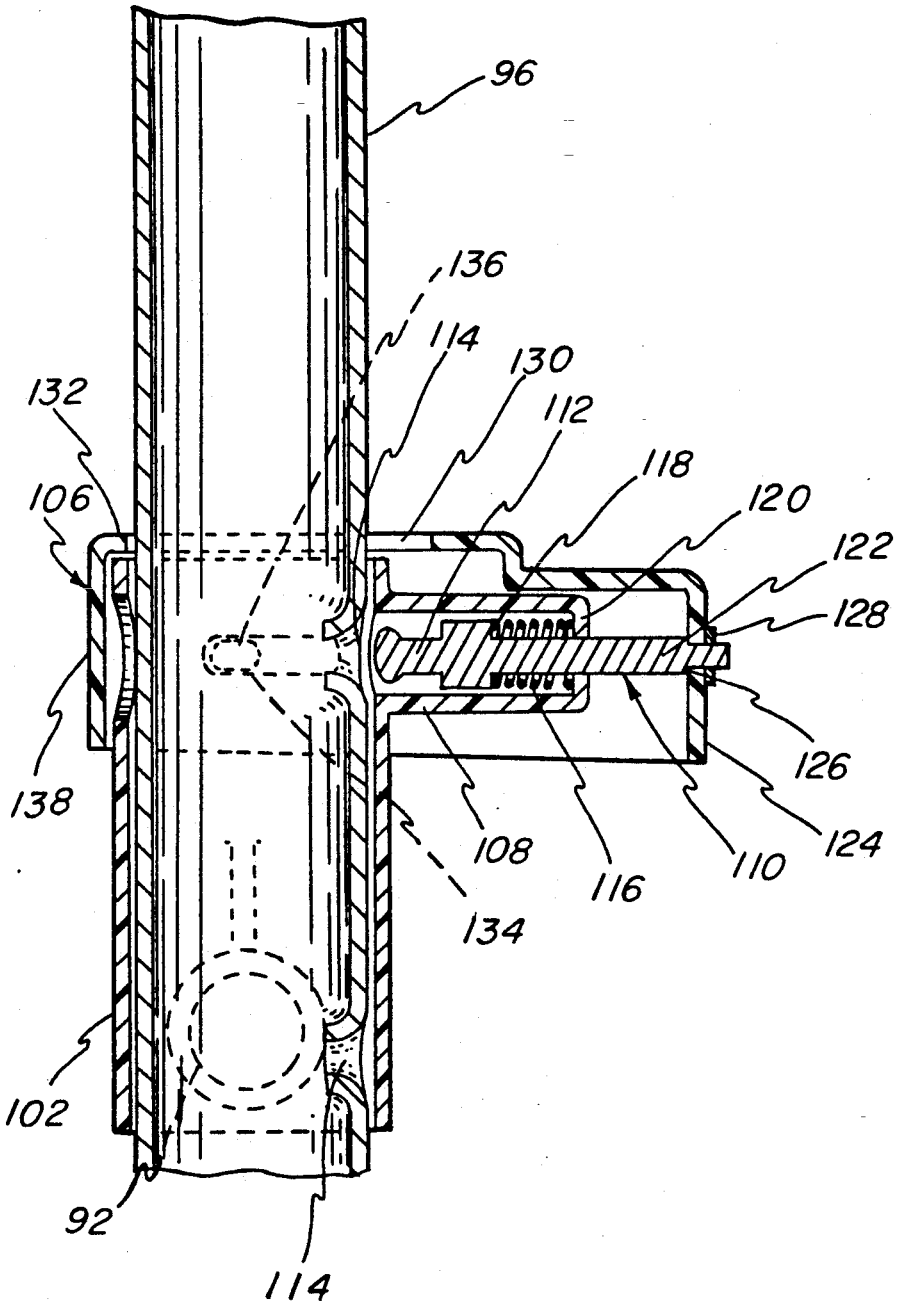
FIG. 8 is a view similar to FIG. 7 in which the collar member is free to slide relative to the leg.
Figure 9:
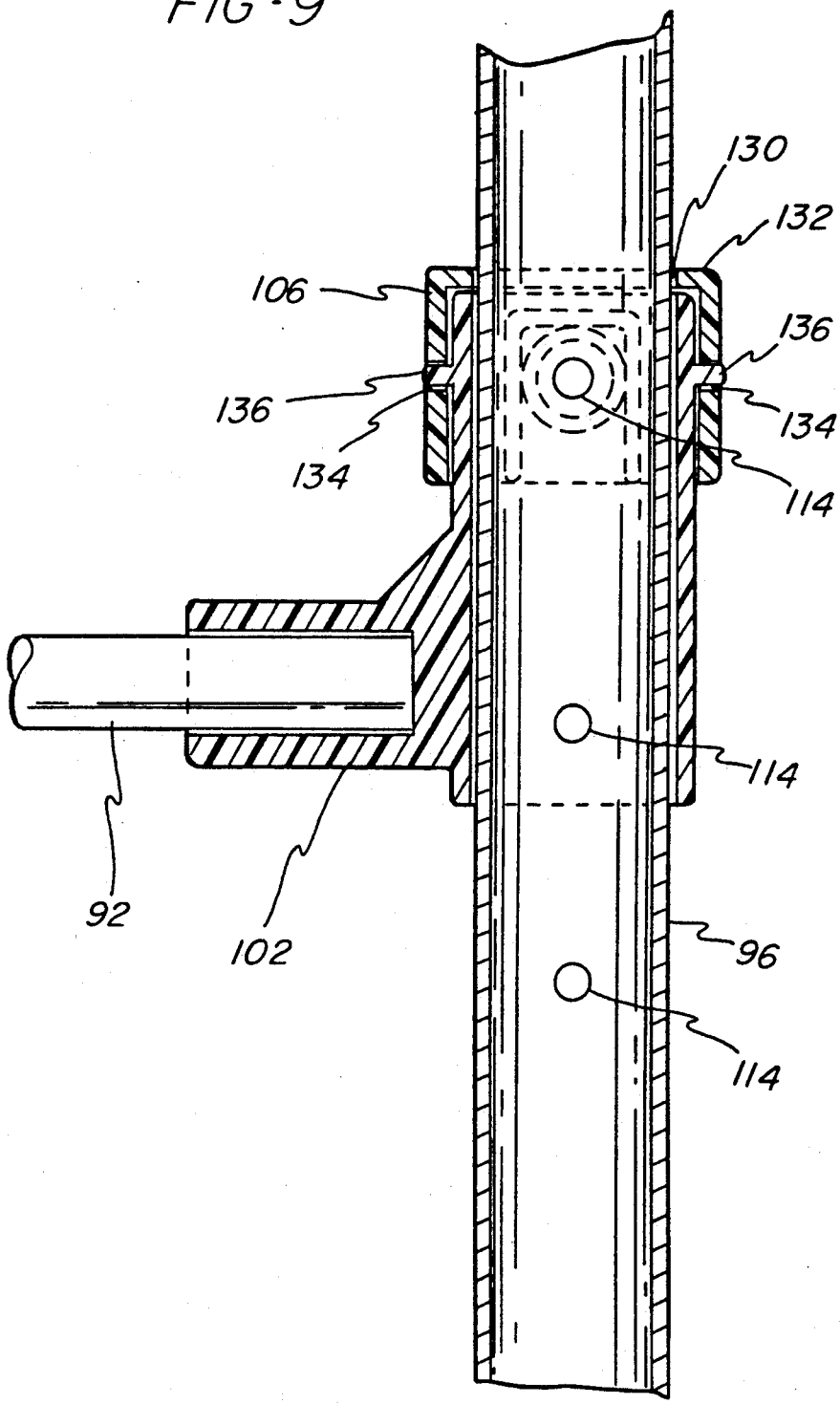
FIG. 9 is a cross sectional view of a front leg taken perpendicular to the view of FIG. 8.

As is illustrated in FIGS. 7–9, in which the collar member 102 and push button 106 are shown as being illustrative of both collar members 100, 102 and push buttons 104, 106, the collar member 102 includes a tubular extension 108 for receiving a plunger 110. The plunger 110 includes a stud 112 which may be selectively positioned within one of a plurality of apertures 114 which are formed at predetermined spaced locations along the back side of the leg element 96. In the preferred embodiment, each of the leg elements 94, 96 are provided with six of such apertures 114 whereby the seat 12 may be selectively positioned at six different heights which are predetermined by the particular positions of the apertures 114.

The plunger 110 is biased inwardly toward the tube 96 by means of a spring 116 which is compressed between a shoulder 118 of the plunger 110 and an end wall 120 of the extension 108 to resiliently bias the stud 112 into engagement with one of the apertures 114. In addition, the plunger 110 includes an outwardly extending shank 122 which extends beyond the end wall 120 of the extension 108 and passes through an aperture in a back wall 124 of the push button 106. The shank 122 includes a shoulder 126 engaging an inner surface of the back wall 124 and a washer 128 is provided attached to the shank 122 for engaging an outer surface of the back wall 124 whereby the plunger 110 is constrained to move with the push button 106.

The push button 106 includes an elongated aperture 130 formed in an upper surface 132 thereof whereby the push button 106 is permitted to move in a longitudinal direction perpendicular to the axis of the leg element 96. Further, the push button 106 includes elongated apertures 134 for receiving guide tab members 136 extending from opposing sides of the collar member 102 (see FIG. 9) for guiding movement of the push button 106 relative to the collar member 102.

Thus, it should be apparent that the seat 12 of the present invention may be moved vertically relative to the leg elements 94, 96 by actuating the push buttons 104, 106 to move from the position shown in FIG. 7 to the position shown in FIG. 8 whereby the plunger elements 110 will be displaced away from the apertures 114 formed in the rear portion of the leg elements 94, 96. With the plungers 110 thus displaced, the collar members 100, 102 will be free to slide upwardly or downwardly to a desired position at which time the springs 116 will again bias the plunger 110 into an aperture 114 to lock the seat 12 against vertical movement. Further, it should be noted that the push buttons 104, 106 each include a front wall 138 which is easily accessed by an operator standing at the front of the chair to adjust the seat 12.

From the above description, it should be apparent that the slots 82, 84 and glide members 78, 80 operate in cooperation with the front leg elements 94, 96 and collar members 100, 102 to guide the seat 12 in smooth sliding movement whereby the seat height may be adjusted between a plurality of predetermined positions. Further, referring to FIG. 10, it should be noted that the slots 82, 84 are formed substantially parallel to the leg elements 94, 96 such that throughout the vertical movement of the seat 12, the angular relationship of the seat to the front and back leg members 20, 22 will remain constant.

It should be apparent that it is necessary for the front leg elements 94, 96 to be parallel to each other since the bar 92 will maintain a constant spacing between the collar members 100, 102 during the vertical movement of the seat 12. In the preferred embodiment, the front leg member 20 is formed as a U-shaped tube including a horizontal lower extension 140 formed integrally with the vertical leg elements 94, 96, and the upper ends of the leg elements 94, 96 are held in constant spaced relationship by means of the bar 72 which maintains the constant spaced relationship between the hinges 24, 26. Further, it should be noted that the front leg elements 94, 96 are attached immovably to the hinges 26, 24, respectively, such that a particularly rigid quadrilateral frame structure is formed by the horizontal portions 72, 140 and vertical portions 94, 96 for guiding and supporting the upper back portion and lower front portion of the seat 12.

The rear leg member 22 is formed similar to the front leg member 20 in that it includes two vertical leg elements 142, 144 aligned substantially parallel to each other and joined by an integrally formed horizontal member 146. The rear leg elements 142, 144 are pivotally attached to the hinges 24, 26 at pivot points 148 (see FIG. 10). Further, a knee lock latch mechanism 150 is provided extending between the front and rear leg members 20, 22 for maintaining the leg members 20, 22 in diverging relationship to each other when the chair 10 is in use. When it is desired to store the chair 10, the latch mechanism 150 may be pivoted upwardly to thereby allow the rear leg member 22 to pivot inwardly toward the front leg member 20 about the pivot point 48.

As may be seen in FIGS. 4 and 6, the front and rear legs members 20, 22 each include a pair of floor engaging feet 152 located at the transition between the vertical and lower horizontal leg members. The feet 152 are formed in the shape of modified triangles including a lower horizontal side 154 for engaging the floor and an adjoining side 156 which extends at an obtuse angle outwardly from the adjoining vertical leg elements 94, 96, 142, 144 immediately above the feet 152. In the preferred embodiment, a maximum angle between the vertical leg elements 94, 96, 142, 144 and the side 156 of their respective feet 152, is approximately 140° to 150°. The feet 152 are dimensioned such that they increase the base width of the chair 10 by approximately an additional 27% over the width provided by the spacing between the vertical element pairs 94, 96 and 142, 144.

It should be noted that the design of the feet 152 is particularly critical to the present invention since the leg elements 94, 96 and 142, 144 are spaced apart a distance less than the overall width of the chair 10 and the feet 152 are required to provide additional stability preventing the chair 10 from tipping over laterally. It should further be noted that in prior art chairs, the tendency to tip laterally was counteracted by providing leg elements which diverge outwardly in a lateral direction in order to provide a wider base width. However, in the present invention in which parallel leg elements 94 and 96 and 142, 144 are required, the additional lateral base width for providing stability must be provided by the uniquely configured feet 152.

From the above description, it should be apparent that the present invention provides a highchair including a tray which may be conveniently adjusted forwardly and backwardly relative to a seat back of the chair. In addition, the present invention provides a highchair wherein the seat height of the seat may be adjusted such that the highchair may be used adjacent to a table without the tray in place wherein the seat height may be adjusted to accommodate the particular height of the table.

Further, the present invention provides a highchair wherein outwardly extending foot portions are provided whereby the lateral stability of the highchair is increased.

While the form of apparatus herein described constitutes a preferred embodiment of the invention, it is to be understood that the invention is not limited to this precise form of apparatus and that changes may be made therein without departing from the scope of the invention, which is defined in the appended claims.

What is claimed is:

1. A highchair comprising:

a seat having arm portions, a removable tray having an upper and a lower surface, said lower surface being adapted to be positioned on said arm portions, latch means mounted on said lower surface for movement toward and away from said arm portions, actuator means mounted on said lower surface adjacent to a front edge of said tray for manual engagement, said actuator means being mounted for longitudinal movement substantially parallel to said lower surface of said tray, transfer means mounted for pivotal movement on said lower side in a centrally located portion of said tray, first linkage means connecting said actuator means and said transfer means, second linkage means connecting said latch means and said transfer means, engagement means on said arm portions for engaging said latch means whereby engagement of said latch means with said engagement means defines a plurality of fixed positions for said tray, wherein manual operation of said actuator means, comprising pulling said actuator means forwardly in a rear to front direction relative to said tray, causes said second linkage means to push laterally outwardly on said latch means such that said latch means disengages from said engagement means for adjustment of said tray relative to said arm portions and further forward movement of said actuator means releases said latch means from engagement with said arm portions for removal of said tray from engagement with said arm portions, and wherein said latch means may be manually operated to disengage from said engagement means and said first linkage means connects to said actuator means through a lost motion connection comprising a slot formed in said actuator means for receiving said first linkage means whereby said actuator means may remain stationary during said manual operation of said latch means.

2. The chair of claim 1, including a torsion spring having opposing ends connected to said tray and said transfer means, said torsion spring operating to move said latch means into engagement with said engagement means and operating to pull said actuator means rearwardly relative to said tray upon release of said actuator means from manual operation.

3. The chair of claim 1, including leg members having floor engaging portions, and means for adjusting the vertical height of said seat member relative to said floor engaging portions whereby said seat may be located at different stationary height positions relative to a floor supporting said floor engaging portions.

4. The chair of claim 1, including first and second pairs of legs and hinge means connecting each of said pairs of legs for pivotal movement relative to each other, said seat being vertically adjustable relative to said hinge means.

5. A highchair comprising:

a seat having arm portions, a removable tray having an upper and a lower surface, said lower surface being adapted to be positioned on said arm portions, latch means mounted on said lower surface for movement toward and away from said arm portions, actuator means mounted on said lower surface adjacent to a front edge of said tray for manual engagement, said actuator means being mounted for longitudinal movement substantially parallel to said lower surface of said tray, transfer means mounted for pivotal movement on said lower side in a centrally located portion of said tray, first linkage means connecting said actuator means and said transfer means, second linkage means connecting said latch means and said transfer means, engagement means on said arm portions for engaging said latch means whereby engagement of said latch means with said engagement means defines a plurality of fixed positions for said tray, wherein manual operation of said actuator means, comprising pulling said actuator means forwardly in a rear to front direction relative to said tray, causes said second linkage means to push laterally outwardly on said latch means such that said latch means disengages from said engagement means for adjustment of said tray relative to said arm portions and further forward movement of said actuator means releases said latch means from engagement with said arm portions for removal of said tray from engagement with said arm portions, and wherein said latch means is manually operable to disengage from said engagement means and a lost motion mechanism is defined between said actuator and said latch means such that said actuator is adapted to remain in a stationary position in response to manual movement of said latch means.

6. The chair of claim 5, wherein said lost motion mechanism includes providing an attachment point between said actuator and said first linkage means where said actuator and said first linkage means are movable relative to each other in a longitudinal direction.

7. A highchair comprising:

a seat defining a seat back, a pair of front leg elements and a pair of rear leg elements, first and second upper members located on laterally opposite sides of said seat, each said upper member being attached to a front leg element and to a rear leg element and wherein said front and rear leg elements extend in diverging relationship from respective ones of said upper members, first and second elongated slots defined along said seat back, said elongated slots extending substantially parallel to said front leg elements and defining openings facing laterally outwardly toward said upper members, first and second tangs mounted to said upper members, each said tang extending laterally inwardly toward and engaging within respective ones of said openings defined by said slots, first and second collars mounted to a front portion of said seat and engaged around respective ones of said front leg elements for sliding movement with respect to said front leg elements, each said collar including a stud, and wherein each said front leg element includes means defining a plurality of detent locations along the length of said front leg elements for receiving said studs to define predetermined vertical adjustment positions for said seat, and said first and second slots each being formed with a length sufficient to continuously retain and cooperate with said first and second tangs during movement of said collars between said detent locations.

8. The chair of claim 7, wherein said upper members comprise hinges defining pivotal mounting points for said rear leg elements to pivot inwardly toward said front leg elements.

9. The chair of claim 7, wherein said detent locations are defined by apertures formed in said front leg elements and said studs comprise end portions of plungers mounted within said collars and biased into engagement with said apertures.

10. A highchair comprising:

a seat defining a front portion and a seat back, an upwardly extending elongated front leg member, an upper member attached to an upper end of said front leg member and extending rearwardly from said front leg member, an elongated first rear guide element defined along said seat back and located rearwardly of said front leg member, said first rear guide element extending substantially parallel to said front leg member, a second rear guide element mounted to said upper member and spaced rearwardly of said front leg member, said second rear guide element extending laterally inwardly toward and engaging with said first rear guide element in continuous sliding engagement to define a rear guide path for said seat, a front guide element mounted to said front portion of said seat and engaged with said front leg member for continuous sliding engagement along said front leg member to define a front guide path for said seat, and wherein said front and rear guide paths are located in front to rear spaced relation to each other to support and guide said seat for vertical height adjustment of said seat.

11. The chair of claim 10, including detent means defined along said front leg member defining a plurality of predetermined locations, said front guide element including means for engaging said detent means to position said seat at different vertical positions.

12. The chair of claim 10, wherein said upper member comprises a hinge and including a rear leg member mounted to said hinge for pivotal movement at a rear attachment point adjacent to said second rear guide element, and said front leg member being attached to said hinge at a front attachment point.

13. The chair of claim 10, wherein said first rear guide element comprises an elongated slot extending upwardly along said seat back and defining an opening facing laterally outwardly toward said upper member for receiving said second rear guide element therein in vertical sliding engagement.

14. The chair of claim 10, wherein said front guide element comprises a collar attached to said front portion of said seat and extending around said front leg member.

* * * * *